United States Patent [19]

Hugo

[11] 4,246,815

[45] Jan. 27, 1981

[54] VOLUMETRICALLY DEFORMED POLYMERIC SUPPORT FOR PUNCHES

[75] Inventor: Harding R. Hugo, Darien, Ill.

[73] Assignee: Danly Machine Corporation, Chicago, Ill.

[21] Appl. No.: 85,051

[22] Filed: Oct. 15, 1979

[51] Int. Cl.[3] ..... B26F 1/14

[52] U.S. Cl. ..... 83/139; 83/140; 83/635

[58] Field of Search ..... 83/138, 139, 140, 635

[56] References Cited

U.S. PATENT DOCUMENTS

| | | | |
|---|---|---|---|
| 3,496,818 | 2/1970 | Porter et al. | 83/140 |
| 3,973,454 | 8/1976 | Eller | 83/140 X |
| 4,166,403 | 9/1979 | Donato | 83/139 X |

*Primary Examiner*—J. M. Meister

*Attorney, Agent, or Firm*—Leydig, Voit, Osann, Mayer & Holt, Ltd.

[57] ABSTRACT

A supporting assembly providing lateral support for the nib of a punch in a power press having a stripper plate to prevent breaking of the punch when punching thick workpieces. The bushing which conducts the nib of the punch through the stripper plate has a coaxial annular recess in its underside. An annular insert of resilient polymeric material, preferably polyurethane plastic, completely fills the recess and presents an inwardly-directed collar surface substantially aligned with the opening in the bushing. The insert is dimensioned to project downwardly a short distance beyond the punch bushing to provide an exposed striking surface for engaging the workpiece as the ram descends. The reaction force of the springs on the stripper plate is sufficient to volumetrically deform the insert causing the inwardly directed collar surface to crowd against the nib of the punch, thereby providing enhanced lateral support for the punch as the punch penetrates the workpiece. In a preferred embodiment of the invention the striking surface of the insert is beveled in a conical locus.

2 Claims, 4 Drawing Figures

VOLUMETRICALLY DEFORMED POLYMERIC SUPPORT FOR PUNCHES

It has been recognized for many years that it is desirable to provide lateral support for the nib of a punch of a power press in the punching of thick workpieces, i.e. workpieces having a thickness equal to or greater than the diameter of the hole being punched. Efforts have been made in the past to utilize polyurethane plastic as a bushing material as evidenced by Porter et al. U.S. Pat. No. 3,496,818 which issued Feb. 24, 1970. Porter et al. proposed to make the entire punch bushing of polyurethane plastic, with the bushing being initially punched by, and subsequently used with, the same punch, thereby to insure intimate contact between the bushing and the nib of the punch. While the idea may be workable in theory, the structure and procedure does not reduce breakage of punches to the anticipated degree, and it has been concluded that, notwithstanding the fact that actual contact exists between bushing and punch, the arrangement provides inadequate lateral punch support. Study shows that one of the reasons for the failure of performance is that polyurethane has an inadequate elastic modulus, or spring rate, when operating in a volumetrically unconfined state.

It is, accordingly, an object of the invention to provide an improved supporting arrangement employing resilient polymeric material, such as polyurethane, in a stripper plate to provide tighter lateral confinement of the nib of the punch than is provided in the prior art, resulting in a substantially reduced breakage rate in the punching of thick, resistant workpieces.

It is a related object of the present invention to provide a punch bushing containing a resilient polymeric element for lateral bracing of the punch in which the tightness of confinement of the punch nib increases with the stroke of the punch and in which confinement is reduced, finally to zero, as the punch completes its return stroke. Stated in general terms it is an object to provide a punch bushing having an element of polyurethane or the like in which the degree of confinement, and hence protecting against breakage, is a maximum over the portion of the punch stroke where breakage is most likely to occur.

It is a related object of the invention to provide a punch bushing having a resilient polymeric element which operates on a cyclical basis to embrace the nib of the punch more tightly than is possible using the polyurethane bushings of the prior art but which nevertheless is durable and long wearing.

It is more specifically an object of the invention to provide a punch bushing having an annular recess with a resilient polymeric element of conforming shape completely filling the recess and projecting a short distance beyond it to provide volumetric confinement and compression in the element resulting in inward expansion into lateral supporting engagement with the nib of the punch as the ram descends. It is, as a result, an object to provide a volumetrically deformable polymeric element, which, while capable of applying a concentrated high level of force against the nib of a punch nevertheless, because of volumetric confinement, is operated safely within its elastic limit for reliable maintenance-free operation over long periods of time.

It is still another object to provide, as an element of a puch assembly in a power press, a stripper plate having a recess with a projecting insert of resilient elastomeric material which, in addition to its primary function of confinement of the punch nib during the punching stroke, brings about a substantial reduction in noise, cushioning the impact of the stripper plate against the workpiece.

It is, finally, an object of the present invention to provide a novel composite guide bushing arrangement for a punch in a power press which greatly reduces breakage of punches in the punching of thick workpieces but which is inherently economical and which may be applied to all punches of the type having an extended nib on a universal basis, both in new presses and, with minor modification in the design of bushing, in presses already in the field.

Other objects and advantages of the invention will become apparent upon reading the attached detailed description and upon reference to the drawing in which.

Figure 2A:
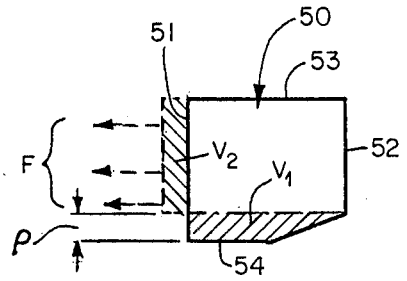
FIG. 2 is an enlarged fragmentary section, also in elevation, showing the striking surface of the resilient polymeric insert in contact with the workpiece but prior to the engagement of the workpiece by the punch.

FIG. 2*a* shows the transformation in the cross section of the insert which occurs on a cyclical basis.

Figure 2:
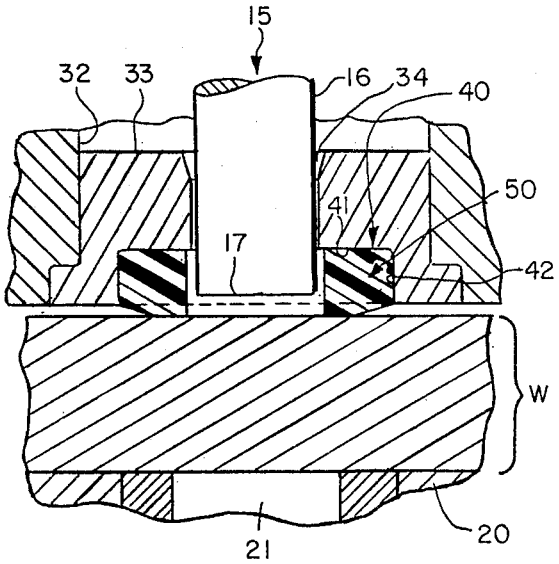
Figure 3:
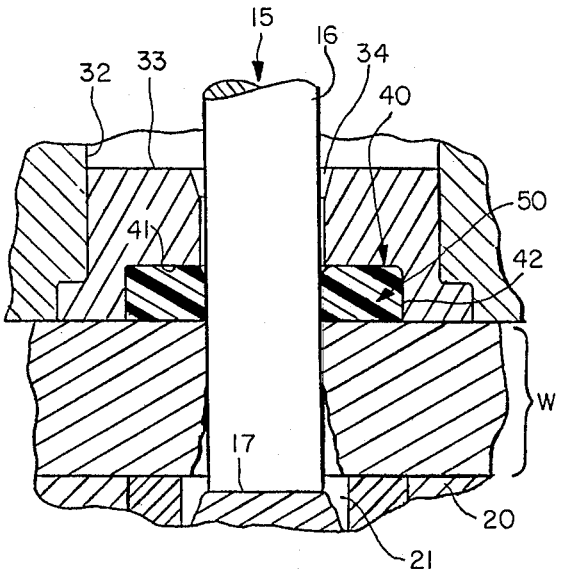

FIG. 3 is a fragmentary section similar to FIG. 2 but showing the condition of the insert during the major portion of the punching stroke.

While the invention has been described in connection with certain preferred embodiments, it will be understood that I do not intend to be limited to the particular embodiments but intend, on the contrary, to cover the various alternative and equivalent constructions included within the spirit and scope of the appended claims.

Figure 1:
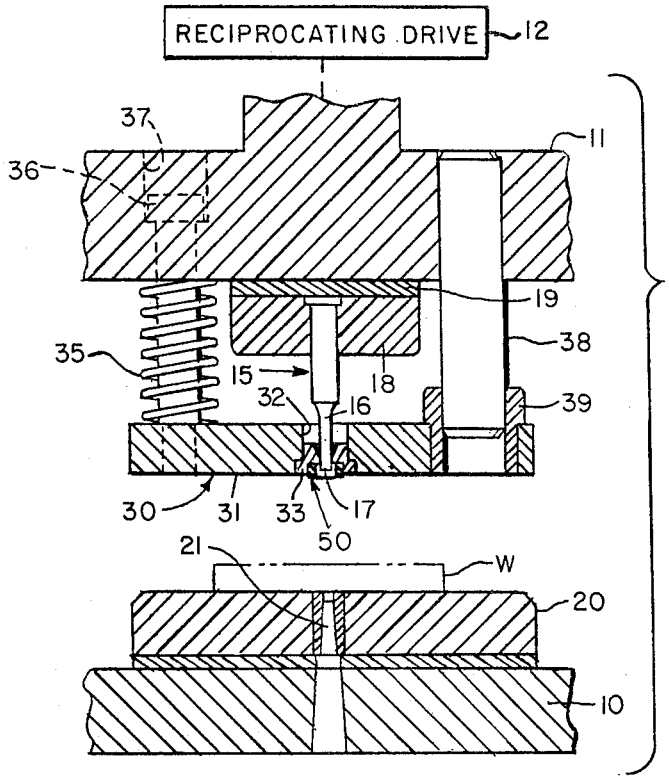
FIG. 1 is a fragmentary section, in elevation, showing the operating area of a power press employing the present invention.

Referring to FIG. 1 there is shown the working area of a press having a bed 10 and a reciprocating ram 11 coupled to a drive 12. Secured to the underside of the ram is a punch 15 having an extended nib 16 of constant diameter with a tip 17. The punch is mounted in a punch plate 18 seated on a backing plate 19.

Aligned with the punch is a die plate 20 having a punch receiving opening, or die cavity, 21. Seated on the die plate is workpiece W. The present invention is particularly concerned with the punching of a "thick" workpiece, which will be understood to be one having a thickness equal to or greater than the diameter of the punch, although the present invention may, if desired, be used with advantage in the punching of thinner materials.

Spaced below the ram and movable with it is a horizontal stripper plate 30 having a face 31 and a central opening 32 in which is fixed a punch bushing 33. The bushing 33 has a clearance opening 34 which has a diameter slightly greater than the nib of the punch. Stripper springs, of which one is shown at 35, interposed between the ram and stripper plate, urge the stripper plate downwardly away from the ram .

The stripper plate 30 is positioned, and the springs are pre-stressed, by means defining a normally extended position for the stripper plate with respect to the ram in which the face of the stripper plate extends downwardly a short distance beyond the tip of the punch. As shown in FIG. 1, this function is performed by retainer bolts 36 which are telescoped within the respective springs, slideable with respect to the ram and with the head of each bolt bottoming in its own recess 37. For positively guiding the stripper plate for movement parallel to the punch axis, two or more guide posts 38 are provided fitted into respective guide post bushings 39.

The function of the stripper plate 30 is, of itself, well known: As the ram descends the stripper plate flatly engages the workpiece and remains stationary as the stripper springs 35 are compressed. Continued downward movement of the ram causes the nib of the punch to penetrate the workpiece, punching out a slug which passes through the opening 21 of the die plate. Upon subsequent upward movement of the ram, and withdrawal of the punch, the stripper springs 35 keep the stripper plate seated upon the workpiece which strips the workpiece from the punch, followed finally by retraction of the stripper plate itself from the workpiece so that it may be readily removed from the working area.

In accordance with the present invention the punch bushing is formed with a coaxial annular recess in its underside. An annular insert of resilient polymeric material completely fills the recess, presenting an inwardly directed collar surface substantially aligned with the clearance opening of the bushing, the insert being dimensioned to project downwardly a short distance beyond the recess to provide an exposed striking surface, with the stripper springs being sufficiently strong so that when the striking surface of the insert engages the workpiece the reaction force is sufficient to volumetrically deform the insert so that the collar surface thereof is crowded against the nib of the punch from all directions.

Thus referring to the punch bushing 33, which is fixed in the stripper plate, an annular recess 40 is formed therein having an upper wall 41 and a cylindrical outer wall 42. The recess is occupied by an annular insert 50 (see FIG. 2*a*) having an inwardly-directed collar surface 51, an outwardly directed surface 52, an upper surface 53 and an exposed downwardly presented striking surface 54. The latter surface projects from the under surface 31 of the stripper plate by an amount p.

Thus when the striking surface engages the workpiece, the lower portion of the insert is forcibly pressed into the recess. Because the insert is volumetrically confined, that is, confined against escape in all directions, it elastically deforms by causing the collar surface 51 to crowd inwardly against the nib, generating a lateral, inwardly directed squeezing force indicated at F. The stripper springs 35 are of such rate, and so prestressed, as to exert sufficient reaction force upon the stripper plate so that the insert becomes deformed to maximum degree, as indicated in FIG. 3, by the time that the axial reaction force of the punch becomes a maximum.

In FIG. 2*a* the upwardly displaced volume of the insert is indicated by the cross hatching at V1 . The inwardly displaced volume, which develops the force F, is indicated by the cross hatched area V2. It is a matter well within the skill of the art to tailor these volumes, by slightly increasing or decreasing the projection p and by adjusting the initial radial clearance between the insert and the nib of the punch, so that when the insert is in its fully compressed state, illustrated in FIG. 3, the force F is at a high optimum level a level which is in any event much greater than that achieved employing the teachings of the above-mentioned Porter et al. patent. It is found that extremely high inward pressures may be generated without exceeding the elastic limit of polymeric materials such as polyurethane, that is, without degrading its elastic recovery characteristics.

As a result when the punch has performed its function, and the ram moves upwardly, the expansion of the stripper springs 35 causes a progressive reduction in reaction force against the stripper plate so that the insert begins to be released. The elasticity of the insert material restores the striking surface 54 to its exposed, projecting position and the inward force F is finally reduced to zero. In other words there is, upon retraction of the ram, automatic removal of the lateral supporting force as the insert reassumes its initial cross section illustrated in FIG. 2. Thus, notwithstanding the generation of a high lateral squeezing force F as the punch is subjected to its peak axial load, it will be understood that the average value of the compressive load is still quite moderate, as a result of which the insert is long lived, requiring little or no attention or maintenance, even when operated at a high cyclical rate.

It will be apparent to one skilled in the art that the benefits of the invention have been achieved on a highly economical basis. All that is required is to form an annular recess in the punch bushing 33 and to seat in such recess a relatively inexpensive annular insert. If desired, the punch bushing may be made integral with the stipper plate, which is to say the recess 40 may be formed directly in the plate. Where a spearate punch bushing 33 is used, as illustrated, stripper plates already in the field may be retrofitted to practice the invention.

While it is preferred to employ as an insert a single piece of polyethylene, it will be understood that the invention is not limited to this and, if desired, a composite insert may be used without departing from the invention Specifically, the exposed striking surface 54 may be covered by a protector in the form of a metal washer secured thereto and which is dimensioned to be received, piston-like, in the recess of the bushing.

While the invention has been descirbed in connection with a punch having a nib of round cross section, the invention is not limited thereto and may be employed with punches of square or other cross section having an extended nib of constant thickness. Thus, the term "annular" as used herein shall be broadly interpreted to mean "in the form of a ring", not necessarily a circular ring and the term "diameter" shall refer generally to the thickness dimension of the nib. Similarly the term "collar" is not limited to a surface of cylindrical shape.

It is one of the features of the present invention that the resilient polymeric material, upon being confined, is volumetrically deformable, specifically between the two states illustrated in FIG. 2*a*, but the material should be chosen so that it is, like polyurethane and like rubber substantially incompressible, volumetrically speaking. Thus the material should be free of air bubbles or voids and should have a high volumetric spring rate. A material meeting these characteristics, upon being compressed axially in the confined state will, due to inward flow of the material, produce a reliably high squeezing force F to provide the enhanced lateral support which is the crux of the invention.

Finally while the invention has been described primarily in terms of use of polyruethane, which is relatively self-lubricating, it may be desirable, when using other resilient polymeric materials such as rubber exhibiting higher friction, to provide auxilliary lubrication which may be done without departing from the invention.

What I claim is:

1. In a punch press for punching a hole in a thick blank of metal, the combination comprising a ram having means for powered reciprocation, a bed mounting a die plate below the ram, a punch on the ram having an extended nib of constant diameter for entering a hole in the die plate, a horizontal stripper plate spaced below the ram and movable therewith, a punch bushing fixed in the stripper plate and having a central clearance opening the guiding the nib of the punch therethrough, stripper springs interposed between the ram and the stripper plate for urging the stripper plate downwardly away from the ram, means defining a normal extended position for the stripper plate with respect to the ram in which the face of the stripper plate extends downwardly a short distance beyond the tip of the punch, the punch bushing having a coaxial annular recess in its underside, an annular insert of volumetrically incompressible resilient polymeric material completely filling the recess and presenting an inwardly-directed collar surface substantially aligned with the clearance opening of the associated bushing, the insert being dimensioned to normally project downwardly a short distance beyond the recess to provide an exposed striking surface for engaging a workpiece interposed between the stripper plate and the die plate as the ram descends, the stripper springs being sufficiently strong so that when the striking surface of the insert engages the workpiece accompanied by compression of the stripper springs, the reaction force is sufficient to volumetrically deform the insert causing the inwardly-directed collar surface thereof to crowd inwardly against the nib of the punch to provide lateral support for the punch as the punch penetrates the workpiece.

2. The combination as claimed in claim 1 in which the striking surface of the insert is beveled in a conical locus to provide an outer edge having an axial dimension which is substantially equal to the depth of the recess while the inner edge has an axial dimension which substantially exceeds the depth of the recess.

* * * * *

UNITED STATES PATENT AND TRADEMARK OFFICE

CERTIFICATE OF CORRECTION

PATENT NO. : 4,246,815

DATED : January 27, 1981

INVENTOR(S) : Harding R. Hugo

It is certified that error appears in the above—identified patent and that said Letters Patent is hereby corrected as shown below:

In Claim 1, line 10, after "opening", delete "the" and substitute therefor --for--.

Signed and Sealed this

Second Day of June 1981

[SEAL]

*Attest:*

RENE D. TEGTMEYER

*Attesting Officer*

*Acting Commissioner of Patents and Trademarks*